US005499014A

United States Patent [19]

Greenwaldt

[11] Patent Number: 5,499,014

[45] Date of Patent: Mar. 12, 1996

[54] SECURITY ALARM SYSTEM

[76] Inventor: Gordon E. Greenwaldt, 6300 82nd Pl. North, Brooklyn Park, Minn. 55445

[21] Appl. No.: 270,145

[22] Filed: Jul. 1, 1994

[51] Int. Cl.[6] ..... G08B 1/08

[52] U.S. Cl. ..... 340/539; 340/545; 340/531

[58] Field of Search ..... 340/545, 546, 340/531, 521, 584, 528, 539

[56] References Cited

U.S. PATENT DOCUMENTS

| | | | |
|---|---|---|---|
| 3,567,882 | 3/1971 | Beck | 200/61.93 |
| 3,641,540 | 2/1972 | Cutler et al. | 340/224 |
| 3,725,887 | 4/1973 | Sneider | 340/224 |
| 3,827,038 | 7/1974 | Willis | 340/224 |
| 3,833,895 | 9/1974 | Fecteau | 340/224 |
| 3,909,722 | 9/1975 | Bennett, Jr. | 325/45 |
| 3,969,709 | 7/1976 | Isaacs et al. | 340/224 |
| 4,148,019 | 4/1979 | Durkee | 340/545 |
| 4,150,369 | 4/1979 | Gaspari | 340/545 |
| 4,191,947 | 3/1980 | Bouchard | 340/545 |
| 4,335,375 | 6/1982 | Schaeffer | 340/539 |
| 4,337,454 | 6/1982 | Iwata | 340/545 |
| 4,536,751 | 8/1985 | Shigemitsu | 340/545 |
| 4,908,604 | 3/1990 | Jacob | 340/528 |
| 4,935,587 | 6/1990 | Pattermann | 200/61.64 |
| 4,990,888 | 2/1991 | Vogt | 340/545 |

*Primary Examiner*—John K. Peng
*Assistant Examiner*—Albert K. Wong
*Attorney, Agent, or Firm*—Kinney & Lange

[57] ABSTRACT

A security alarm system includes a wireless transmitter unit, a portable control unit, and a receiver unit. The transmitter unit includes a sensor for detecting the opening of a door or window to a protected area and an alarm signal generator for providing an alarm signal wherein the alarm signal generator is controlled by the sensor. The control unit includes an arm signal generator for providing and transmitting an arm signal and a disarm signal generator for providing and transmitting a disarm signal. The receiver unit includes an alarm for indicating unauthorized opening of the door or window to the protected area, a first circuit for receiving the alarm signal from the transmitter unit and activating the alarm when the alarm is armed, a second circuit for receiving the arm signal from the control unit and arming the alarm, and a third circuit for receiving the disarm signal from the control unit and disarming the alarm and for turning the alarm off when the alarm is activated.

9 Claims, 4 Drawing Sheets

SECURITY ALARM SYSTEM

BACKGROUND OF THE INVENTION

The present invention relates to security alarm systems, and more particularly, to a wireless security alarm system for detecting the unauthorized opening of a window or door to a protected area.

In the past, security alarms have typically involved complex circuitry and components which were difficult to install difficult or impossible to remove and use in other locations, and expensive to purchase. Wireless systems have been proposed and have included various sensors to determine the unauthorized opening of a window or a door to a protected area which would trigger a receiver alarm unit located somewhere else in the house or building. However, these units typically require a key switch to activate and deactivate the alarm unit to prohibit unauthorized persons from deactivating the alarm. The key switches are time consuming and inconvenient to operate.

Hand held control units have been provided with an emergency panic switch to trigger the alarm to summon help in the event an intruder is spotted in the dwelling or in the event of an illness or injury. These hand held units have also been provided with inhibit switches which temporarily deactivate the alarm to allow entry to and exit from the protected area without setting off the alarm. However, all of these wireless security alarm systems are fixed to the building, house or other object being protected so that they are difficult to remove and use in other locations. In addition, since these "fixed" units are difficult to install they are often very expensive to purchase. It is desirable to provide a wireless portable security alarm which is inexpensive, easy to manufacture and easy to install and reinstall in a variety of locations such as in homes, cars, boats, campers, trucks etc.

SUMMARY OF THE INVENTION

The present invention relates to a security alarm system having a portable wireless transmitter unit, a portable wireless control unit, and a portable wireless receiver unit. The transmitter unit includes a mounting member for removable attaching the transmitter unit to a door or window, a sensor for detecting the opening of the door or window and an alarm signal generator (controlled by the sensor) for providing an alarm signal. The control unit includes an arm signal generator for providing and transmitting an arm signal and a disarm signal generator for providing and transmitting a disarm signal. The receiver unit is operable stand alone or when connected to an external power source. The receiver unit includes an alarm for indicating unauthorized opening of the door or window to the protected area, a first circuit for receiving the alarm signal from the transmitter unit and activating the alarm when the alarm is armed, a second circuit for receiving the arm signal from the control unit and arming the alarm, and a third circuit for receiving the disarm signal from the control unit and disarming the alarm and for turning the alarm off when the alarm is activated.

In one embodiment, the portable control unit of the security alarm further includes a panic signal generator for providing and transmitting a panic signal and the receiver unit further includes a fourth circuit for receiving the panic signal from the control unit and activating the alarm when the alarm is armed.

DETAILED DESCRIPTION OF THE PREFERRED EMBODIMENTS

Figure 1:
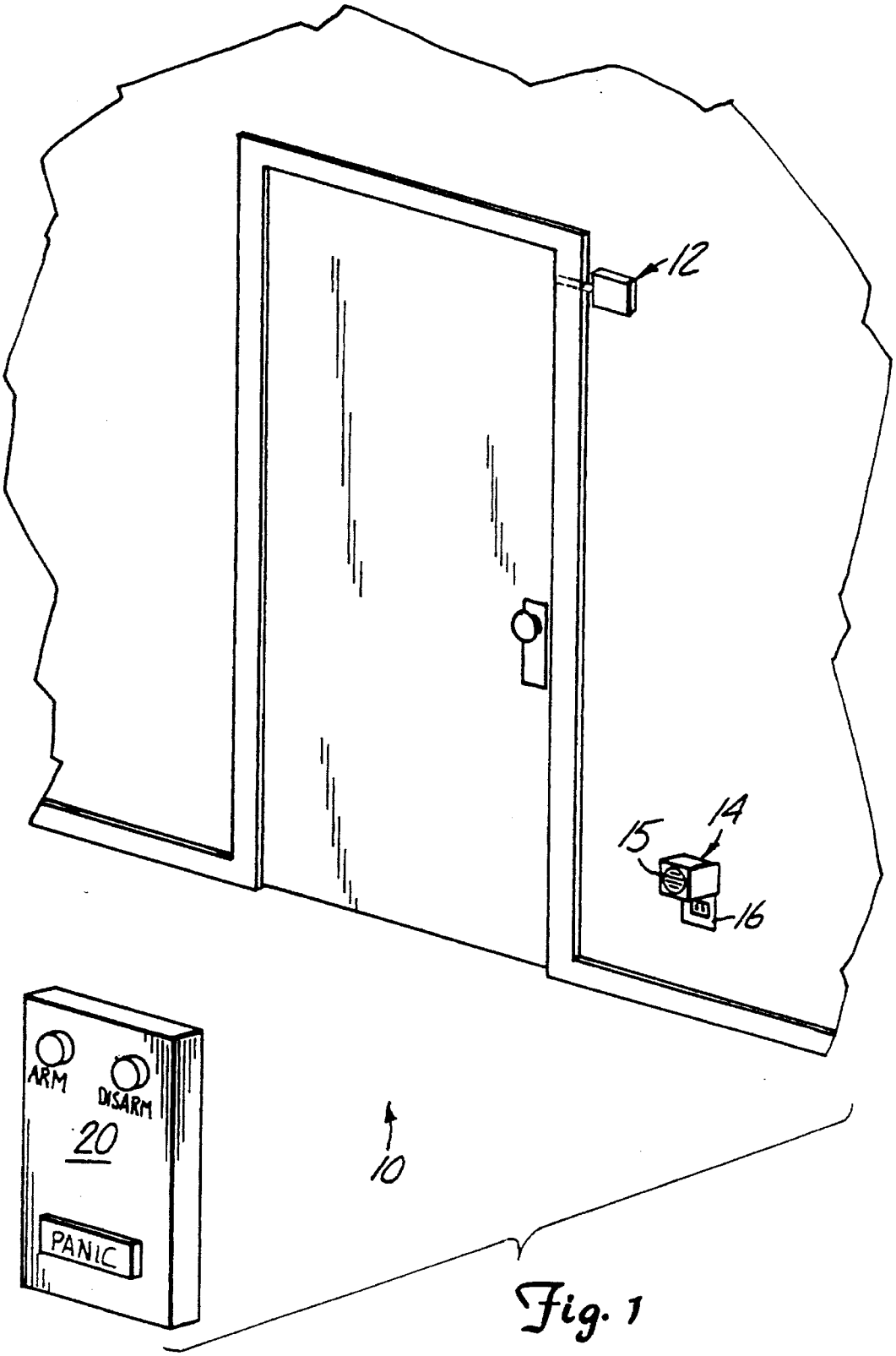
FIG. 1 is a perspective view of the security alarm system according present invention.

Referring to FIG. 1, a security alarm system 10 is illustrated in a house, building or other protected area for providing alarm indications in response to an unauthorized entry into a protected area. The security alarm system 10 includes at least one wireless portable transmitter unit 12, a portable wireless receiver alarm unit 14 and a portable wireless control unit 20. As shown in FIG. 1, wireless portable transmitter unit 12 is mounted to a door or window within the house for detecting the opening of the door or window and for providing an alarm trip signal in response to the opening of the door or window. The transmitter unit is mounted to a door or window frame by nails, screws, bolts, adhesive or other similar mounting means which permits easy mounting and easy removal of the transmitter unit. The portable receiver alarm unit 14 is mounted to a wall outlet 16 in the house and includes an alarm 15 Portable control unit 20 provides a panic signal, an arm signal, and a disarm signal. The panic signal triggers the alarm 15 in the event the user is surprised by an intruder in the protected premises or in the event the user is seeking help or assistance for other reasons. The arm signal arms the alarm 15 so that it can be activated when the alarm trip signal is received. The disarm signal disarms the alarm 15 so that it cannot be activated by the alarm trip signal and also turns off the alarm 15 after it has been triggered.

Figure 2:
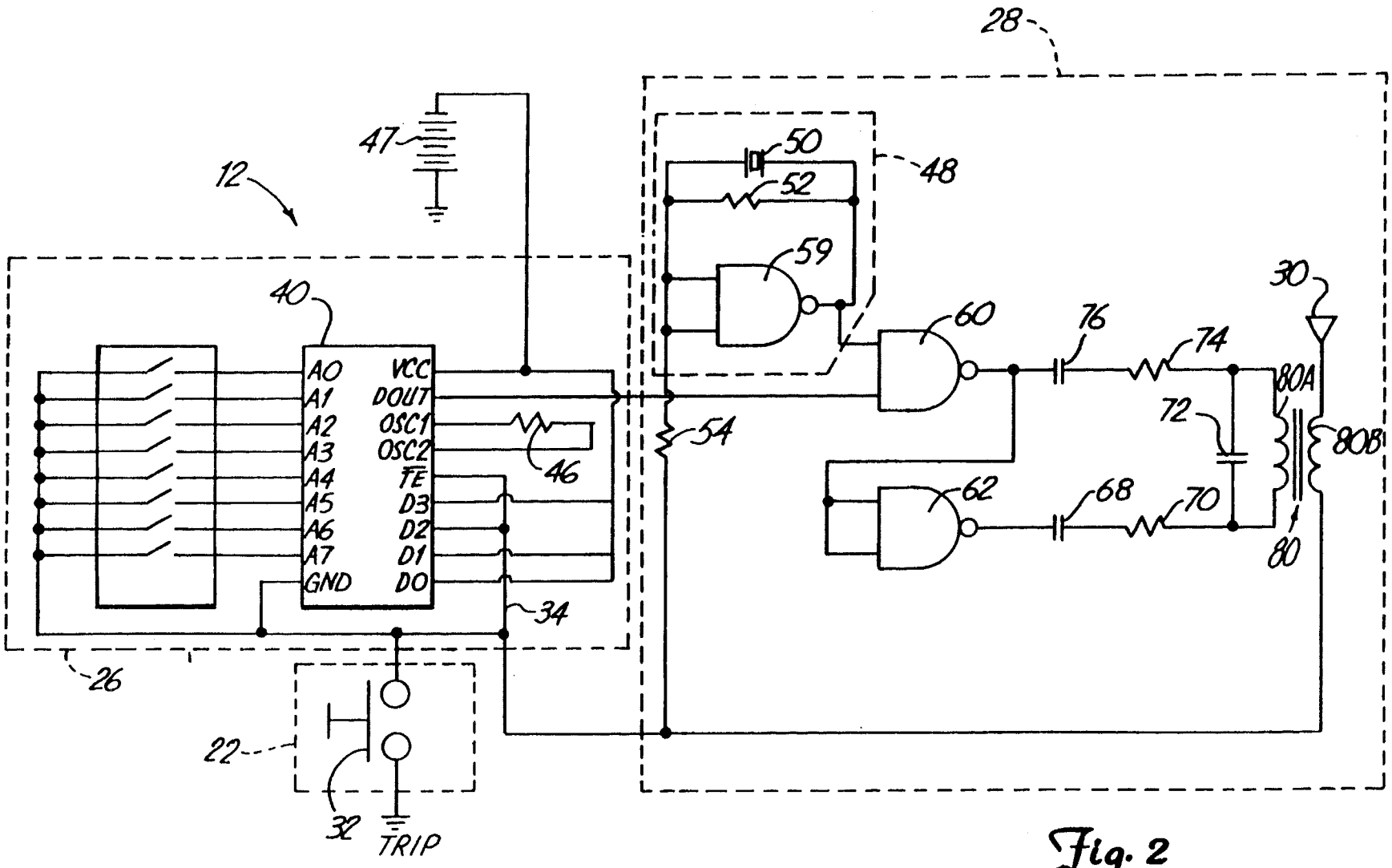
FIG. 2 is a schematic diagram of the wireless transmitter unit of the security alarm system according to the present invention.

As shown in FIG. 2, transmitter unit 12 includes a sensor 22 for detecting the opening of the door or window, an alarm signal encoder 26 for providing the alarm trip signal in response to the activation of sensor 22, and an alarm signal generator 28 for transmitting the encoded alarm trip signal to the receiver unit 14.

The sensor 22 may be any type of electrical, mechanical or magnetic switch and is illustrated as a pushbutton electrical switch 32 which is normally open when the door or window is closed. When the door or window is opened the switch 32 closes to activate the alarm signal generator 26. By connecting the switch 32 to ground, (ground side switching) the entire circuitry for the transmitter unit 12 is "off" thereby extending battery life. The sensor 22 provides an activation signal to the alarm signal encoder 26 along line 34. In addition, the pushbutton switch 32 closes the circuits for the alarm signal encoder 26 and the alarm signal generator 28. Although the illustrated transmitter unit will continuously transmits the alarm trip signal after the pushbutton switch 32 is closed until the door or window is closed, a timed disarm circuit (not shown) may be provided to automatically disarm the transmitter after a predetermined time to save battery life. Additionally, it is within the intended scope of the invention to provide a timed pulse or burst alarm trip signal over fixed time period, enough to activate the alarm 15 in the receiver unit 14 but short enough to save battery life. In the latter scenario the receiver unit would have a timed disarmed circuit (not shown) to automatically disarm the receiver unit after a predetermined time.

The alarm signal encoder 26 includes a Holtek HT-12E encoder 40, and a series of eight (8) dip switches 41 connected to the encoder 40 inputs. The encoder 40 encodes 12 bits of information which represents the alarm trip signal and serially transmits this information from pin $D_{out}$ upon receipt of the activation signal at pin TE on line 34. The 12 bits of encoded information includes eight bits which are set by the dip switches 41 which are connected to the pins A0–A7 of the HT-12E encoder 40 and four data input bits at pins D0–D3 of the HT-12E encoder 40. The dip switches 41 are set in a particular configuration to change the encoded alarm trip signal at pin $D_{out}$. The eight dip switches provide 256 encodable signal combinations to prevent users from inadvertently activating the receiver unit 14 in someone else's house. The data inputs pins D3, D2, D1 and DO of the HT-12E encoder 40 represent the particular "type" of signal being transmitted by the encoder 40. For example, the D3 input of the HT-12E encoder 40 represents the panic signal, the D2 input of the HT-12E encoder 40 represents an alarm trip signal, the D1 input of the HT-12E encoder 40 indicates an arm signal, and the DO input of the HT-12E encoder 40 represents a disarm signal. Therefore, the "type" of signal transmitted by the HT-12E encoder 40 depends on which of pins D3–D0 receives a low activation signal. Since the transmitter unit 12 only sends the alarm trip signal data input pins D3, D1 and D0 of the HT-12E encoder 40 are connected to a 9V battery source 47 so that they are held at a high logic level. Pin D2 of the HT-12E encoder 40 is connected to ground through the pushbutton switch 22. When the pushbutton switch 22 is closed a low logic signal is sent to pin D2 causing the alarm trip signal to be transmitted to the receiver unit 14.

The HT-12E encoder 40 includes an internal oscillator for outputting an encoded alarm signal at a first frequency set by the internal oscillator. The HT-12E uses a resistor 46 between pins OSC1 and OSC2 to set the data rate. Preferably resistor 46 is 1.1 MΩ which provides a frequency of 3 kHz for the encoded signal at pin $D_{out}$.

Alarm signal generator 28 transmits the encoded alarm trip signal from pin $D_{out}$ of the HT-12E encoder 40 using a carrier signal created by an oscillator circuit 48. Oscillator circuit 48 includes a crystal 50 to control the transmission frequency, a resistor 52 in parallel with the crystal 50 and a NAND gate 59. Crystal 50 and resistor 52 are connected in parallel across both inputs and the output of NAND gate 59. Crystal 50 is selected such that the transmission frequency is 27 MHz, which is the current FCC assigned frequency for unlicensed transmitters. A resistor 54 is positioned between the inputs to NAND gate 59 and ground.

The data output pin, $D_{out}$, of the HT-12E encoder 40 controls the output from oscillator circuit 48 through a NAND gate 60. One input of NAND gate 60 is connected to the output of NAND gate 59 of oscillator circuit 48 while the other input to NAND gate 60 is connected to pin $D_{out}$ of the HT-12E encoder 40. The alarm trip signal outputted at pin $D_{out}$ of the HT-12E encoder 40 therefore is combined and carried with the output of oscillator circuit 48 depending on the activation signal created by the pushbutton sensor switch 32.

The output of NAND gate 60 is connected to the inputs of a NAND gate 62 for inverting the alarm trip signal. The output of NAND gate 60 is also connected with the output of NAND gate 62 through a capacitor 68, a resistor 70, a capacitor 72, a resistor 74 and a capacitor 76. A primary winding 80A of a transformer 80 is connected in parallel across capacitor 72 so that the voltage difference across capacitor 72 drives the transformer 80. A secondary winding 80B of transformer 80 has one end connected to the antenna 30 for transmitting the alarm trip signal to the receiver unit 14. The other end of secondary winding 80B is connected to pin TE of encoder 40 and to ground through pushbutton switch 22. When the door or window is opened, pushbutton switch 22 is closed thereby causing a low logic signal at pin TE of the HT-12E encoder 40 and closing the circuit for the alarm signal encoder 26 and for the alarm signal generator 28. The alarm trip signal at pin $D_{out}$ of the HT-12E encoder 40 is combined with the carrier signal created by the oscillator circuit 48. The antenna 30 then transmits the alarm trip signal continuously to receiver unit 14 while the door or window is opened.

Figure 3:
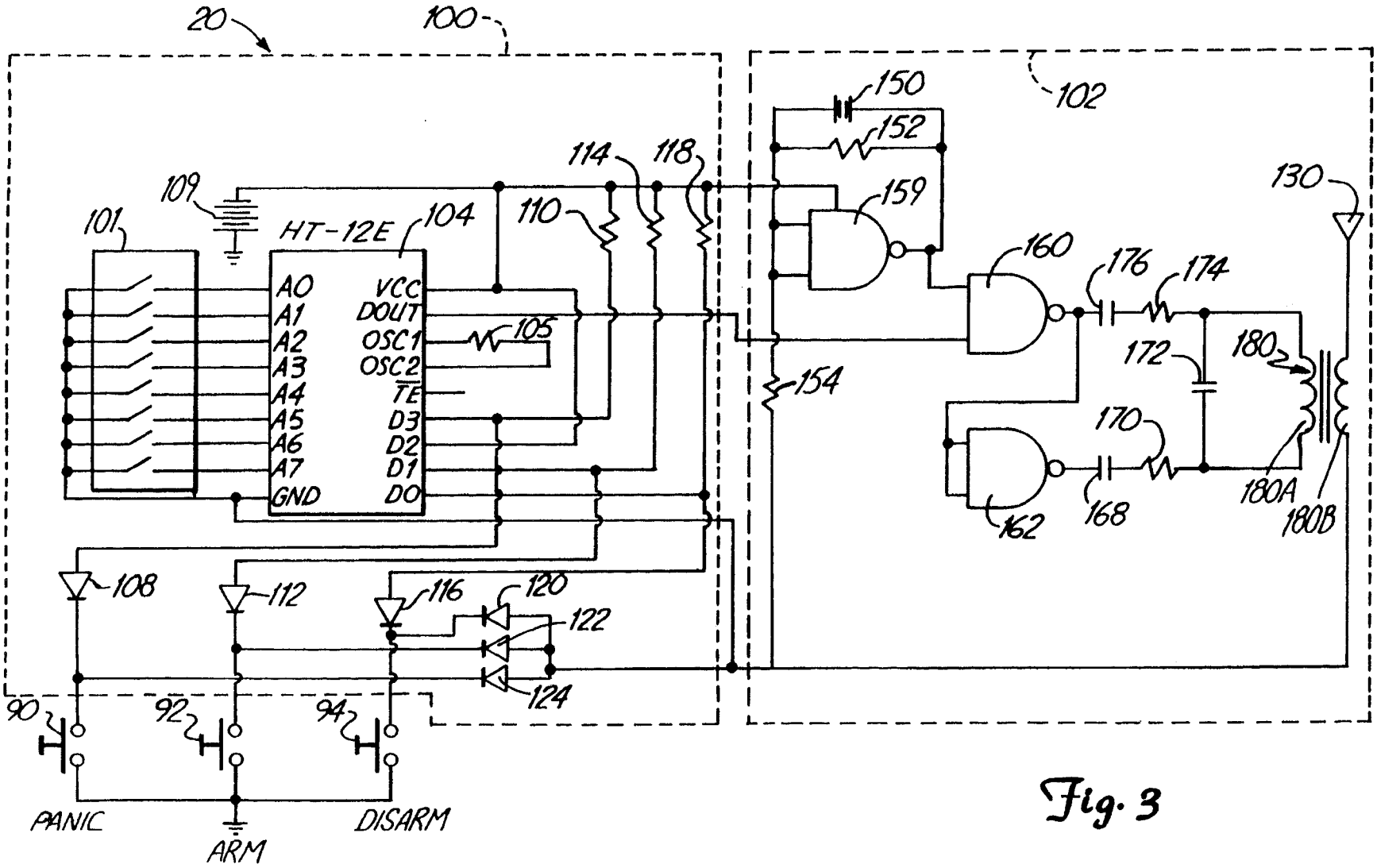
FIG. 3 is a schematic diagram of a portable control unit of the security alarm system according to the present invention.

As shown in FIG. 3, portable control unit 20 includes a panic switch 90 for triggering a panic signal, an arm switch 92 for triggering an arm signal, a disarm switch 96 for triggering a disarm signal, a signal encoder 100 for encoding the panic signal, arm signal and disarm signal in response to activation of panic switch 90, arm switch 92 and disarm switch 94, respectively, and a signal generator 102 for transmitting the panic signal, arm signal and disarm signal to receiver unit 14.

Panic switch 90, arm switch 94 and disarm switch 96 are, for example, pushbutton switches which are normally open such that when an operator pushes one of the buttons the switch is closed, thereby generating the desired function. The signal encoder 100 includes dip switches 101 identical to the dip switches 41 on the transmitter unit 12 for encoding the first eight bits of the encoded panic signal, arm signal and disarm signal. Preferably, the dip switches 101 are set the same as the dip switches 41 on the transmitter unit 12. Signal encoder 100 also includes an HT-12E encoder 104, which is configured with an internal oscillator the same as in the transmitter unit 12 shown in FIG. 2. Panic switch 90 is connected to pin D3 of the HT-12E encoder 104 through a diode 108 and to a 9 Volt voltage source 109 through a resistor 110. Arm switch 92 is connected to pin D1 of the HT-12E encoder 104 through a diode 112 and to voltage source 109 through a resistor 114. Disarm switch 94 is connected to pin D0 of the HT-12E encoder 104 through a diode 116 and to voltage source 109 through a resistor 118. Thus, the resistors 110, 114 and 118 act as pull-up resistors which connect pins D3, D1 and DO to the voltage source 109. Voltage source 109, which is preferably a 9 V battery, is connected to pin D2 of the HT-12E encoder 104 for providing a high logic signal, since the alarm trip signal is being sent by transmitter unit 12 (see FIG. 2). Panic switch 90, arm switch 92 and disarm switch 94 are connected through diodes 120, 122, and 124, respectively, to alarm signal generator 102. Diodes 108, 112, 116, 120, 122, and 124 are biased to isolate panic switch 90, arm switch 94 and disarm switch 96. Thus, when a switch 90, 94, 96 is closed the respective pin D3, D1 or DO on the HT-12E encoder 104 receives a low logic signal causing the appropriate signal to be transmitted to receiver unit 14. Depression of a pushbutton switch supplies power to alarm signal generator 102 for transmitting the appropriate signal from the control unit 20 only while the button remains depressed.

Alarm signal generator 102 of control unit 20 is identical in structure and operation to the alarm signal generator 28 in the transmitter unit 12 and so reference is made to the related description of FIG. 2 wherein the same reference numbers are used in FIG. 3 increased by one-hundred In addition, the internal oscillator of the HT-12E encoder 104 is set to 3 kHz, which is the same as the frequency of the signal transmitted by the transmitted unit 12, by using a 1.1MΩ resistor 105 between pins OSC1 and OSC2 of the HT-12E encoder 104. As with the HT-12E encoder 40, the signal output from the pin $D_{out}$ of the HT-12E encoder 104 is dependent upon which of the switches 90, 94, 96 is activated due to the internal architecture of the HT-12E encoder 104. The encoded signal at the pin $D_{out}$ of the HT-12E encoder 104 is connected to NAND gate 160 as in the transmitter unit 12, so that either the panic signal, arm signal or disarm signal is transmitted at 27 MHz from the antenna 130 to the receiver unit 14 depending upon which pushbutton switch 90, 92, 94 is depressed.

Figure 4:
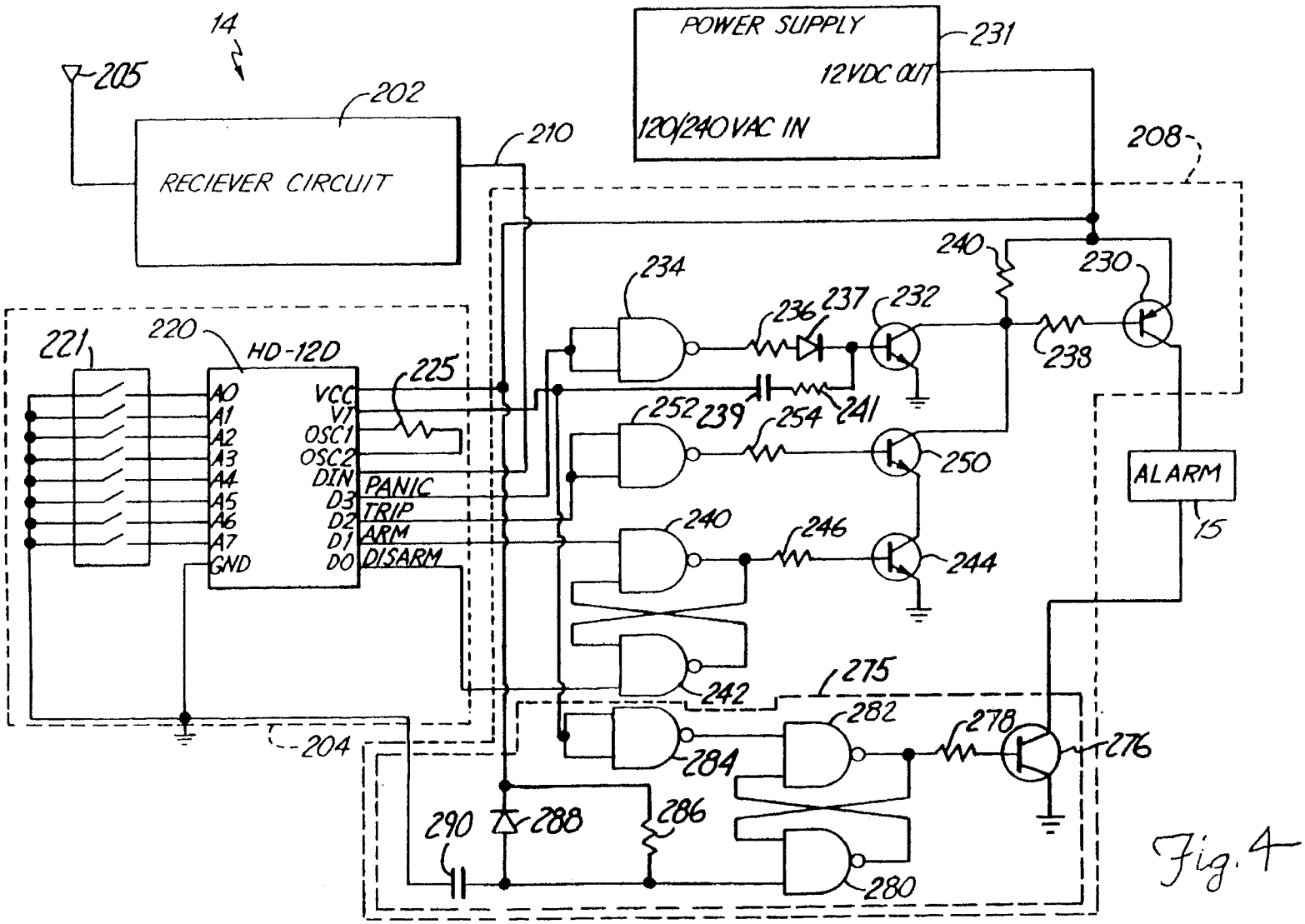
FIG. 4 is a schematic diagram of the receiver/alarm unit of the security alarm system according to the present invention.

As shown in FIG. 4, receiver unit 14 includes the alarm 15 for indicating unauthorized opening of the door or window in a protected area, a receiver circuit 202 for receiving the encoded alarm trip signal from transmitter 12 and the encoded panic signal, arm signal and disarm signal from control unit 20, a signal decoder 204 for decoding the encoded signals and logic circuitry 208 for arming, tripping and disarming the alarm 15.

The receiver unit 14 is constructed, for example, from a RF Decoder/Receiver, part no. RE-99, available from Ming Engineering and Products, Inc, 17921 Rowland Street, City of Industry, Calif. 91748. Receiver circuitry 202 on the RF Decoder/Receiver includes an antenna 205 and a Super Regenerative AM Receiver for receiving electromechanical signals transmitted from transmitter unit 12 and control unit 20. Receiver circuitry 202 filters signals at 27 MHz so that the trip signal, panic signal, arm signal, and disarm signal are fed into decoder 204 along line 210. Receiver circuitry 202 is well known to those skilled in the art and so is shown in block format. Signals from the transmitter 12 and the control unit 20 are received form the antenna 205 and fed through the receiver circuitry 202 into the pin $D_{in}$ on a Holtek HT-12D decoder 220. Dip switches 221 are set identical to dip switches 41 and 101 on transmitter unit 12 and control unit 20, respectively. Within the HT-12D decoder 220 there are comparators for differentiating between the panic signal, trip signal, arm signal and disarm signal. After the signal has been decoded it is then sent to the appropriate output pin D3, D2, D1 and D0, respectively, of the HT-12D decoder 220. The data outputs D3–D0 are latched within the HT-12D so that they are maintained in their current state until another transmission is received at pin $D_{in}$. The operation of the internal oscillator in the Holtek HT-12D decoder 220 on the unit 14 is identical to the operation of the internal oscillator on transmitter unit 12 and control unit 20. A resistor 225, preferably 1.1MΩ between OSC1 and OSC22 sets the frequency of the output signals at 3 KHz.

Alarm 15 may be a bell, siren or horn as is well known in the art. Alarm 15 is connected to a power supply 231 through a transistor 230. That is, the collector of transistor 230 is connected to alarm 15 and the emitter of transistor 230 is connected to power supply 231, so that transistor 230 acts as a switch which activates alarm 15 depending on the signal at the base of transistor 230. The power supply 23 1 operates on both AC from a household 120/240 volt supply and on DC through a battery backup to supply power to alarm 15 in the event of a failure of the household power source. The DC battery backup is sufficient to last several months, preferably one year or more, so that the security alarm system 10 may be used independently of a household power supply.

The output pins D0–D3 of the HT-12D decoder 220 are connected through logic circuity 208 to the base of transistor 230. Output pin D3 of the HT-12D decoder 220 represents the panic signal and is connected to the inputs of a NAND gate 234 for inverting the low signal transmitted at pin D3. The output of NAND gate 234 is connected through to a resistor 236 and a diode 237 to the base of a transistor 232. The emitter of transistor 232 is connected to ground and the collector of transistor 232 is connected to the base of transistor 230 through a resistor 238, and to the power supply 231 through a resistor 240. A low signal at pin D3 from the panic signal is inverted by NAND gate 234, which turns transistor 232 "on" thereby turning transistor 230 "on" to activate the alarm 15.

Pins D1 and DO of the HT-12D decoder 220 represent the arm and disarm signals, respectively, and are connected to the inputs of respective NAND gates 240 and 242. The outputs of NAND gates 240 and 242 are connected to the input of the other respective NAND gate 242 and 240 to form an SR flip flop or latch. The output of NAND gate 240 is connected to the base of a transistor 244 through a resistor 246. The emitter of transistor 244 is connected to ground and the collector of transistor 224 is connected to the emitter of a transistor 250 which acts as a trip signal switch. When a disarm signal is outputted at pin DO of the HT-12D decoder 220, transistor 224 is turned "off" so that the trip signal, if received, cannot activate alarm 15. The feedback between the output of NAND gate 240 and the input of NAND gate 242 provides an SR latch which maintains the output of NAND gate 240 after the arm signal is removed from the input of NAND gate 240 and after the disarm signal is removed from the input of NAND gate 242. Thus, the disarm signal outputted at pin DO of the HT-12D decoder 220 turns transistor 244 "off" which prevents the needed voltage drop across the base-emitter junction of transistor 230. In other words, regardless of the state of transistor 250 due to the trip signal, the alarm circuit is open and the alarm 15 will not be activated if the disarm signal has turned transistor 244 "off".

When an arm signal is outputted at pin D1 of the HT-12D decoder 220, the state of the SR flip flop is reversed so that the output at NAND gate 240 is high thereby turning transistor 244 "on" which will permit the needed voltage drop across the base-emitter junction of transistor 230. In other words, the alarm circuit is now closed, and alarm 15 will be activated depending on the state of transistor 250 dictated by the alarm trip signal.

Pin D2 of the HT-12D decoder 220 is connected to the inputs of NAND gate 252 which inverts the low alarm trip signal when received. The output of the NAND gate 252 is connected to the base of transistor 250 through a resistor 254. The collector of transistor 250 is connected to the base of transistor 230 through resistor 238, to power supply 231 through resistor 240 and to the collector of transistor 232. The emitter of transistor 250 is connected to the collector of transistor 244. When a trip signal is outputted at pin D2, NAND gate 252 inverts the low signal which then provides a sufficient voltage drop across the base-emitter junction of transistor 250, thereby turning transistor 250 "on". When the receiver unit 14 is armed, that is, when transistor 244 is "on", the activation of transistor 250 turns transistor 230 is then turned "on"which activates alarm 15.

The receiver unit 14 notifies the user of the arming and disarming of the alarm 15 by providing an audible "chirp". The chirp is sounded by activation of the transistor 232 similar to the activation of the alarm when the panic button is pressed. More specifically, the base of transistor 232 is connected to pin VT of the HT-12D decoder 220 through a capacitor 239 and a resistor 241. Pin VT provides a high signal any time a "valed transmission" signal (arm signal, disarm signal, panic signal, alarm trip signal) is decoded by HT-12D decoder 220. The size of the capacitor 239 determines the length of time transistor is "on"and therefore the time period of the chirp.

In the event the HT-12D decoder 220 malfunctions when turned on and does not disable the outputs at pins D3–D0 which otherwise would cause inadvertent sounding of alarm 15, the logic circuitry 208 includes a disable circuit 275. The disable circuit disables the alarm 15 by "open circuitry" the alarm circuit. The disable circuit includes transistor 276, resistor 278, NAND gates 280, 282 and 284, resistor 286, diode 288 and capacitor 290. The collector of transistor 276 is connected to alarm 15. The emitter of transistor 276 is connected to ground. The base of transistor 276 is connected to pin VT of the HT-12D decoder 220 such that when any transmission signal is received by the receiver unit 14, the transistor 276 is turned "on" and maintained "on"until the power supply 231 is disconnected. More specifically, pin VT is connected to inputs of NAND gate 284. The output of NAND gate 284 is connected to one of the inputs of NAND gate 282. One of the inputs of NAND gate 280 is maintained at a high logic level by capacitor 290 which is connected to power supply 231 through resistor 286 and diode 288. NAND gate 280 and 282 form an SR latch which maintain a low logic signal at the output of NAND gate 282 until any transmission signal causes a high signal at pin VT which permanently activates transistor 276 until power supply 231 is disconnected.

An additional level of security may be obtained by providing a "911" transmitter (not shown) is associated with the alarm/receiver unit 14. The "911" transmitter would notify a police headquarters over the "911" emergency telephone lines when the alarm 15 is activated to provide immediate and assured police attention.

Thus, the security alarm system 10 according to the present invention provides a wireless portable security system which is inexpensive due to the simplicity of its components, operations and manner of installation and use. The portable receiver unit includes an alarm and is mounted to any household power outlet. The portable transmitter unit 12 easily mounts to any window for activating the alarm upon an unauthorized entry. The portable hand-held remote control unit 20 is a convenient and easy to use unit for arming and disarming the alarm and for activating an alarm panic mode at the push of a button.

Although the present invention has been described with reference to preferred embodiments, workers skilled in the art will recognize that changes may be made in form and detail without departing from the spirit and scope of the invention.

What is claimed is:

1. A portable security alarm system consisting of:

a portable wireless transmitter unit including:

sensor means for detecting the opening of a door or window in a protected area;

alarm signal generating means for providing an alarm signal, the alarm signal generating means being controlled by the sensor means;

mounting means for removably attaching the transmitter unit to a door or window so that the transmitter is portable;

a portable wireless control unit which provides the exclusive means for arming and disarming the alarm system, the control unit including:

emergency panic signal generating means including a panic button for providing and transmitting an emergency panic signal;

arm signal generating means including an arm button for providing and transmitting an arm signal;

disarm signal generating means including a disarm button for providing and transmitting a disarm signal; and a portable wireless receiver unit operable stand alone and when connected to an external power source, the receiver unit does not have any control indicators thereon such that the receiver unit can be located in an out-of-the-way or hidden location, the receiver unit including:

an audible alarm for indicating unauthorized opening of the door or window in the protected area;

first circuit means for receiving the alarm signal directly from the transmitter unit and activating the alarm when the alarm is armed via a direct electrical connection to the alarm;

second circuit means for receiving the arm signal from the control unit and arming the alarm;

third circuit means for receiving the disarm signal from the control unit and disarming the alarm and for turning the alarm off when the alarm is activated; and fourth circuit means for receiving the emergency panic signal from the control unit and activating the alarm whether or not the alarm is armed.

2. The security alarm of claim 1, wherein the receiver unit includes means audible for indicating that the alarm is armed and disarmed.

3. The security alarm of claim 1, wherein the mounting means is selected from a group consisting of nails, screws bolts and adhesive.

4. The security alarm of claim 1, wherein the receiver unit further includes electrical connection means for connecting the receiver unit to a standard household power source.

5. The security alarm of claim 4, wherein the receiver unit further includes battery backup means for powering the receiver unit in the event of a failure of the household power source.

6. The security alarm of claim 1, wherein the sensor means is a pushbutton switch.

7. The security alarm of claim 1, wherein the arm signal generating means includes a pushbutton switch which is normally open so that when the switch is activated the arm signal is transmitted to the receiver unit.

8. The security alarm of claim 1, wherein the disarm signal generating means includes a pushbutton switch which is normally open so that when the switch is activated the disarm signal is transmitted to the receiver unit.

9. The wireless, portable security alarm system of claim 1, wherein the transmitter unit includes a magnetic sensor for detecting the opening of the door or window, and for providing the alarm signal in response thereto.

* * * * *

UNITED STATES PATENT AND TRADEMARK OFFICE

CERTIFICATE OF CORRECTION

PATENT NO. : 5,499,014

DATED : March 12, 1996

INVENTOR(S) : GORDON E. GREENWALDT

It is certified that error appears in the above-indentified patent and that said Letters Patent is hereby corrected as shown below:

On the title page item [54], and col. 1, line 1, in the title before "SECURITY", insert -- PORTABLE--

Col. 1, line 42, after "relates to a ", insert --portable--

Signed and Sealed this

Twenty-fifth Day of June, 1996

*Attest:*

Bruce Lehman

BRUCE LEHMAN

*Attesting Officer*

*Commissioner of Patents and Trademarks*